United States Patent [19]

Bigi

[11] 4,088,464

[45] May 9, 1978

[54] METHOD AND APPARATUS WITH A SINGLE RECTIFYING COLUMN FOR AIR FRACTIONATION

[75] Inventor: Emanuele Bigi, Bergamo, Italy

[73] Assignee: S.I.A.D. Societa Italiana Acetilene E Derivati, Bergamo, Italy

[21] Appl. No.: 669,421

[22] Filed: Mar. 22, 1976

[30] Foreign Application Priority Data

Mar. 26, 1975 Italy ..... 21662 A/75

[51] Int. Cl.[2] ..... F25J 3/04

[52] U.S. Cl. ..... 62/22; 62/28; 62/29; 62/44

[58] Field of Search ..... 62/22, 33, 27, 28, 29, 62/30, 13, 39, 38, 41, 44

[56] References Cited

U.S. PATENT DOCUMENTS

| | | | |
|---|---|---|---|
| 2,627,731 | 2/1953 | Benedict | 62/30 |
| 2,982,108 | 5/1961 | Grunberg | 62/28 |
| 3,127,260 | 3/1964 | Smith | 62/29 |
| 3,269,131 | 8/1966 | Becker | 62/28 |
| 3,564,571 | 2/1971 | Yearout | 62/28 |
| 3,605,423 | 9/1971 | Stoklosinski | 62/28 |

*Primary Examiner*—Hiram H. Bernstein
*Attorney, Agent, or Firm*—Remy J. VanOphem

[57] ABSTRACT

A method for the fractionation of air is described allowing the separation of oxygen, nitrogen and argon by a single fractionation column from the top of which gaseous nitrogen is drawn and to which liquid nitrogen is recycled, whereas from the bottom of the column liquid oxygen is drawn which is then heated and recycled into the same, a gaseous product enriched in argon being drawn from an intermediate zone of the fractionation column. The apparatus for carrying out the method comprises substantially one single rectification column which is connected on its top to a drawing and cooling circuit for gaseous nitrogen and recycling circuit for liquid nitrogen; on its middle zone to the supplying line for compressed, cooled and expanded air to be fractionated; and on its bottom to a drawing and heating circuit for liquid oxygen to be partially recycled to the same bottom zone.

15 Claims, 1 Drawing Figure

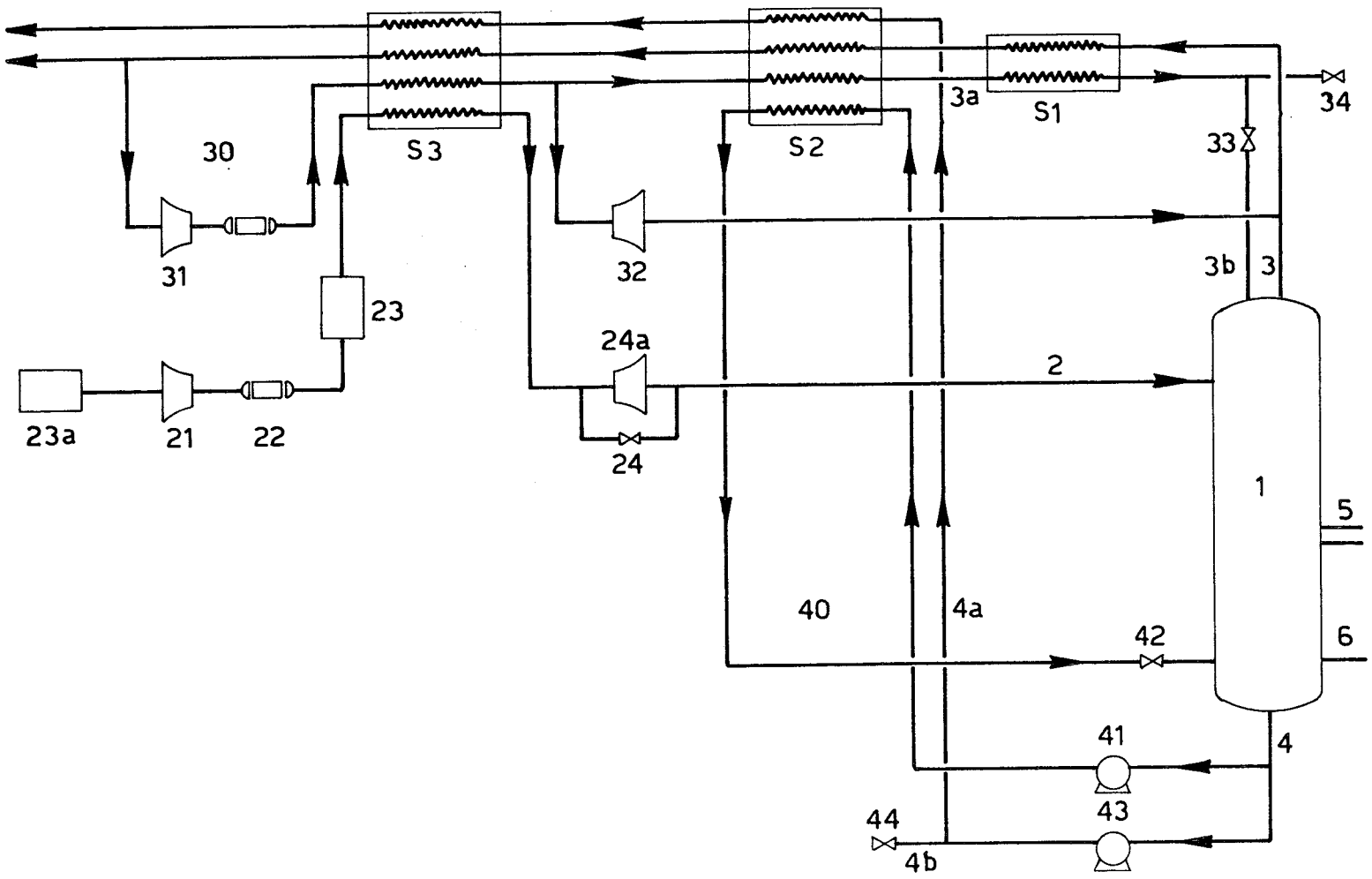
34
33
3
3b
1
5
6
4
S1
3a
2
42
41
43
4a
4b
44
S2
40
32
24a
24
S3
23
30
31
22
21
23a

METHOD AND APPARATUS WITH A SINGLE RECTIFYING COLUMN FOR AIR FRACTIONATION

BACKGROUND OF THE INVENTION

The present invention refers to a method and an apparatus for simultaneously producing oxygen and nitrogen from air fractionation by means of a single rectifying column.

It is known that air fractionation for firstly producing oxygen and nitrogen, and possibly argon and other rare gases, is obtained by subjecting liquid air to a distillation step and, due to the fact that boiling temperatures of the three main components are respectively rising for nitrogen, argon and oxygen, in any process nitrogen will be obtained on top of the distillation column, oxygen at the bottom thereof, whereas argon will accumulate in an intermediate position.

It is also known that all methods and apparatus now employed for simultaneously obtaining oxygen and nitrogen pure enough for industrial uses, all of them substantially deriving from the two fundamental process of Linde and Claude, are of the double rectification type, i.e. with two superimposed columns mutually separated by a heat exchanger, the lower one, also named exhaustion column, working at a pressure greater than the one existing in the upper or real rectification column, in which the reflux of liquid nitrogen takes place.

Obviously the use of a single distillation column, namely a process by single rectification, would be highly advantageous as regards the simplicity of building, the overall dimensions and installation costs.

Nevertheless the use of a single rectification tower such as the one of the original Linde cycle has given poor results, mainly when both $O_2$ and $N_2$ are desired to be got in the pure state as an outcome of the process. In fact, whereas the oxygen obtainable from the bottom of the column can have a satisfactory purity, the nitrogen leaving the top end of the same column yet contains generally at least 6% oxygen. Likewise it is possible to get $N_2$ pure enough, whereas oxygen contains at east 5% $N_2$ and Ar.

SUMMARY OF THE INVENTION

It has been now designed and is the object of the present invention a method for the air fractionation with the production of oxygen and nitrogen pure enough by means of a single rectification column.

The method according to the present invention is characterized in that air drawn from atmosphere is compressed, treated by methods known per se, cooled in a heat exchanger and supplied to a fractionation column, from the upper part of which gaseous nitrogen is drawn, and refluxed liquid nitrogen which has been liquefied outside the column is then recycled, and from the bottom thereof liquid oxygen is drawn, which is then heated and again recycled to the lower zone of the column.

Another object of the present invention is a plant designed to carry out said method and comprising substantially one single rectification column which is connected on its upper end to a drawing and cooling circuit for gaseous nitrogen and recycling circuit for liquid nitrogen; on its middle zone to the supplying line for compressed, cooled and then expanded air to be fractionated; and on its lower zone to a drawing and heating circuit for liquid oxygen which is then recycled to the same lower zone.

The method and the plant according to the present invention allow to further obtain important advantages with respect to the methods and plants of the prior art.

First of all it is evident a remarkable simplification of structure and lesser overall dimensions, particularly in height, due to the presence of a single fractionation column. Moreover the general energy consumption is reduced and, by working in the whole column at a lower pressure, which is the same existing only in the upper column of conventional plants with double rectification, a further saving of materials and seals is reached particularly with respect to columns and heat exchangers.

During the experiments which have been carried out, there have been found high purities in $N_2$ and $O_2$ obtained, yet preserving at the same time the possibility of drawing from an intermediate zone of the same column a gas which is sufficiently rich in argon to be conveniently used as a raw material for producing pure argon.

BRIEF DESCRIPTION OF THE DRAWING

These and further objects, advantages and characteristics of the method and the relevant plant according to the present invention will be evident to those skilled in the art from the following detailed description of an embodiment thereof which is given as a non limiting example with reference to the annexed sole drawing representing a schematic view of the plant according to the present invention.

DESCRIPTION OF THE PREFERRED EMBODIMENT

With reference to the figure, the head of the fractionation column 1 is connected, through a duct 3, to a circuit 30 for the liquefaction of gaseous nitrogen drawn through the same duct 3. A tube **3*a* pipes to the utilization place the liquid nitrogen produced, a part of which is recycled in the column head 1 through conduit 3*b***.

A line 2 supplies in the interior of column 1 air to be fractionated and a conduit 4 leaves the base of the column to draw two fractions of liquid oxygen, one of which is heated and recycled to the lower zone of column 1 and the other is forwarded to the utilization place.

It is to be noted that the rectification or fractionation column 1 is any known column for fractional distillation comprising a number of transverse baffles or mutually overhanging "plates" which can contain suitably formed solid bodies of appropriate materials, the so called "filling bodies".

The method according to the present invention, with reference to the disclosed plant and assuming this latter is running on steady condition, is carried out as follows:

Gaseous nitrogen evolves from boiling air fed in 2 and is drawn through conduit 3 from the top of fractionation column 1 at a relative pressure between 0 and 5 $Kg/cm^2$. Such gaseous nitrogen is thus supplied to circuit 30 where it is first heated countercurrently in heat exchanger S1 by nitrogen from branch 30, then in heat exchanger S2 still by the same nitrogen and oxygen of circuit 40 and branch **4*a* coming out from the bottom of the column. Finally nitrogen flowing in 30 is heated to room temperature in exchanger S3 by compressed nitrogen, as will be explained later, and by air to the fractionated from line 2**.

A portion of nitrogen thus heated is used directly in the gaseous state, whereas a fraction of it is compressed in a compressor 31 to a relative pressure over 5 $Kg/cm^2$. This compressed nitrogen is then cooled in exchanger S3 as previously mentioned by means of nitrogen coming out from the top of the column, air to be fractioned and gaseous oxygen. Subsequently a portion of this nitrogen is expanded through an expansion machine 32 (e.g. a turbine) which is working and cools nitrogen to the lowest possible temperature being the same of nitrogen at outlet 3. The fraction of nitrogen not subjected to the expansion is further cooled in the compressed state in the heat exchangers S2 and S1 as previously mentioned to let it down to the temperature of nitrogen coming out from the column head and from turbine 32. Nitrogen thus cooled and compressed changes to the liquid state and the liquid nitrogen is fed through a throttling valve 34 to the utilization place, whereas a portion of liquid product can be drawn through a throttling valve 33 and conduit **3*b* and forwarded to the head of the rectification column 1** in order to achieve the reflux which is necessary for the regular operation of the column.

The evolution of nitrogen gas from air fed in 2 makes the liquid product at the bottom of column 1 rich in oxygen so that it can be substantially regarded as liquid pure $O_2$. Such a liquid is forwarded by a recycle pump 41 at a relative pressure of from 0 to 40 $Kg/cm^2$ through conduit 4 in a circuit 40. In such a circuit liquid oxygen is transferred to exchanger S2 where it flows countercurrently to nitrogen which has to be liquefied in order to supply liquid nitrogen in branch **3*a* as well as to gaseous nitrogen coming from the top portion of the column; oxygen withdraws calories from both nitrogen flows, thus heating up simultaneously. This oxygen thus heated up to a temperature from −150° to −100° C suited for nitrogen in S2 and possibly up to the room temperature is then recycled through throttling elements 42** to the bottom portion of the column to generate the flow of gases going up the column and causing firstly the separation of nitrogen and secondly of argon.

Always from the bottom of column 1 and in case through the same conduit 4 is drawn liquid and/or gaseous oxygen not to be recycled in the column. This fraction of oxygen is supplied by a pump 43 through the pipe **4*a* to heat exchangers S2 and S3 so that it can reach the room temperature in countercurrent with air and nitrogen to be liquefied. From said pipe 4*a* gaseous $0_2$ is obtained after the flowing in said heat exchangers, or upstream these a fraction of liquid product can be drawn through pipe 4*b* and throttling member 44**.

Air to be fractionated which was drawn from atmosphere is supplied in column 1 through pipeline 2 along which it is subjected to a compression up to a pressure value which can be slightly higher than atmosphere pressure or can reach even higher values, yet preferably not higher than 200 $kg/cm^2$. By means of known methods and devices, such as molecular sieves, alumina, silica gel and the like, generally shown in the drawing by reference numbers 22 and 23 and possibly connected between subsequent compressors 21, air is dried, purified and then supplied to heat exchanger S3 countercurrently to nitrogen and oxygen coming from the fractionation column 1, as previously mentioned, thus being cooled to a temperature in the range from −120° to −194° C. Air thus cooled is then forwarded through a throttling element 24 to column 1, where it separates into $0_2$, $N_2$ and Ar. When a production of liquid oxygen and/or nitrogen is required, air is caused to expand, before entering column 1, by means of an expansion machine **24*a*, shown in the drawing as paralleling the throttling element 24**, which machine is working and lowers the temperature of the air to a value which is as near as possible to the liquefaction temperature of air.

As mentioned above, the foregoing description of the method according to the present invention as well as of the operation of relevant plant was referred to an operation on steady condition, wherein at the top of the column is yet evolving a sufficient flow of gaseous nitrogen and the liquid product at the bottom of the column is substantially pure oxygen. In reaching such a condition, i.e. in the starting step, there are no substantial differences with regard to known double rectification cycles. In fact nitrogen is more and more growing thanks to the reflux which can be strengthened at the beginning by means, for instance, of an external source of liquid nitrogen, so that the starting times can be reduced.

By 5 has been shown in the unique figure a pipeline for drawing, from an intermediate zone of column 1, a product which is rich enough in argon and can be further enriched afterwards in order to obtain pure argon. By 6 has besides been shown a pipeline for drawing from column 1 gaseous oxygen ready for use upon heating.

Possible additions and/or modifications may be made by those skilled in the art to the above described and illustrated embodiment of the method according to the present invention as well as of the relevant plant designed to put the same into practice, without sorting from the scope of the invention.

What is claimed is:

1. A method for recovering oxygen, nitrogen and argon from air by means of a single rectification column, comprising:

(a) compressing atmospheric air,
(b) purifying the air,
(c) drying the air,
(d) cooling the air by countercurrent heat exchange with returning recovered nitrogen from the column in a first heat exchanger,
(e) feeding the cooler air to the upper half of the column,
(f) withdrawing cooled nitrogen gas from the top of said column,
(g) withdrawing liquid oxygen from the bottom of said column,
(h) withdrawing an argon stream intermediate said column,
(i) externally of the column liquefying a fraction of the withdrawn nitrogen gas by countercurrent heat exchange with a fraction of the withdrawn liquid oxygen, the liquid oxygen becoming gaseous, the liquefaction being achieved by:
  (1) passing the liquid oxygen fraction countercurrent to a fraction of the returning recovered nitrogen in a second heat exchanger, the withdrawn nitrogen gas from the column passing through the second heat exchanger concurrently with the liquid oxygen fraction, and
  (2) passing the withdrawn nitrogen gas initially through a third heat exchanger countercurrently to the returning recovered nitrogen, the returning recovered nitrogen becoming liquefied,
(j) recycling the liquefied nitrogen gas to the top of the column as a reflex nitrogen, and (k) recycling the gaseous oxygen to the lower portion of the column.

2. The process of claim 1, wherein the liquefaction of gaseous nitrogen coming out from the top of said fractionation column occurs by means of the following working steps: heating in at least a heat exchanger; compressing up to a pressure higher than the outlet pressure from said column; cooling by causing it to flow countercurrently in at least the same heat exchanger in which it flowed before the compression; causing to expand a fraction thereof up to the same pressure and temperature as the one existing at the outlet of gaseous nitrogen; recycling said expanded fraction; letting again as refluxed liquid into the top of the fractionation column nitrogen cooled up to the liquefaction, by causing it to flow through a throttling element; the rest portion being the produced liquid nitrogen.

3. The method of claim 1, wherein the drawing of liquid oxygen from the bottom of said fractionation column occurs by means of a recycling pump and said oxygen is heated up to a temperature from the room temperature to the one existing at the outlet from said column by causing it to firstly flow through at least one of said heat exchangers countercurrently with the flow of said gaseous nitrogen to be liquefied and then through a throttling element before it enters again the bottom of said fractionation column.

4. The method of claim 3, wherein a portion of oxygen drawn from the bottom of the fractionation column is not recycled and a fraction thereof heated up to room temperature is used as produced gaseous oxygen, the other fraction which is not heated and caused to flow through a throttling element being used as produced liquid oxygen.

5. A method according to claim 1, wherein air to be fractionated is caused to expand, after cooling and before forwarding it to said column, in an expansion machine which is working and causes it to cool down to a temperature which is near the one of liquefaction.

6. The method of claim 2, wherein nitrogen is heated up to room temperature, at which temperature it can be drawn as gaseous nitrogen for use; compressed up to a pressure from 5 to 200 $Kg/cm^3$, cooled firstly up to a temperature in the range from $-100°$ to $-150°$ C and then caused partially to cool by expansion to the initial outlet temperature and pressure of gaseous oxygen which are respectively in the range from $-180°$ to $-196°$ C and from 0 to 5 $Kg/cm^2$ and partially further cooled up to the liquefaction temperature of nitrogen corresponding to said compression pressure.

7. An apparatus for carrying out the method of claim 16 comprising:

(a) a single rectification column having a top portion for withdrawing nitrogen gas, a bottom portion for withdrawing liquid oxygen and an intermediate portion for withdrawing an argon stream;

(b) a nitrogen recycling circuit in fluid communication with the top portion of the column, the circuit comprising:

(1) heat exchange means including first, second and third heat exchangers for cooling and liquefying a fraction of withdrawn nitrogen gas by countercurrent flow with a fraction of withdrawn liquid oxygen through the first and second heat exchangers, and (2) reflux means for refluxing the liquid oxygen from the third heat exchanger in the top portion of the column;

(c) atmospheric air supply means connected to the column at the top portion thereof, the supply means being connected to the first heat exchange to cool the air by a flow countercurrent to the gaseous nitrogen and liquid oxygen; and (d) a circuit for recycling oxygen connected to the bottom of the column and in fluid communication therewith, the circuit comprising:

(1) the second heat exchanger to heat a fraction of the liquid oxygen withdrawn from the bottom by countercurrent flow to the returning gaseous nitrogen, to render the oxygen gaseous and (2) means for returning the gaseous oxygen to the bottom of the column, and wherein the circuits and the heat exchange means are located outside the column.

8. The apparatus of claim 7, wherein said nitrogen recycle circuit comprises two countercurrent flows for each one of a number of heat exchangers respectively at increasing temperatures, at least a compressor and at least an expansion machine.

9. The apparatus of claim 8, wherein said nitrogen recycle circuit is connected to the top of said column through a pipe and said expansion machine is connected in the backflow branch of said circuit, having the outlet directly connected to said pipe and the inlet paralleling the backflow paths of at least one heat exchanger at lower temperature, disposed mutually in series on a line connected in turn to the top of column through a throttling element and to the utilization place of produced liquid nitrogen.

10. The apparatus of claim 7, wherein said circuit for oxygen is connected to the bottom of column through a conduit comprising a recycling pump, at least a flowpath of said heat exchangers at a higher temperature and a throttling element through which the circuit come back to the bottom of said column.

11. The apparatus of claim 10, wherein said recycling pump on said conduit is connected in parallel to another pump for partially drawing liquid oxygen, forwarding through a pipeline to the utilization place the produced gaseous oxygen throughout further flowpaths of said heat exchangers and supplying to the utilization place the produced liquid oxygen through a pipeline and a throttling element.

12. The apparatus of claim 7, wherein said line for air comprises at least a compressor, drying and purifying elements at least a flowpath in said heat exchangers at a higher temperature and a throttling element having the outlet connected to said column.

13. The apparatus of claim 12, wherein said throttling element is an expansion machine.

14. The apparatus of claim 7, further comprising a pipeline for drawing gaseous argon from column.

15. The apparatus of claim 7, further comprising a pipeline for drawing gaseous $O_2$ from column and forwarding it to the utilization place.

* * * * *

UNITED STATES PATENT AND TRADEMARK OFFICE

CERTIFICATE OF CORRECTION

PATENT NO. : 4,088,464

DATED : May 9, 1978

INVENTOR(S) : Emanuele Bigi

It is certified that error appears in the above-identified patent and that said Letters Patent are hereby corrected as shown below:

Column 5, line 52, delete the numeral "16" and insert therefor the numeral ---1---.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,088,464

DATED : May 9, 1978

INVENTOR(S) : Emanuele Bigi

It is certified that error appears in the above-identified patent and that said Letters Patent are hereby corrected as shown below:

Column 4, line 68, delete "reflex" and insert therefor ----reflux----.

Column 6, line 3, delete "oxygen" and insert therefor ----nitrogen----.

Signed and Sealed this

*Tenth* Day of *July 1979*

[SEAL]

*Attest:*

*Attesting Officer*

LUTRELLE F. PARKER

*Acting Commissioner of Patents and Trademarks*